United States Patent [19]

Wuthrich

[11] Patent Number: 4,647,218

[45] Date of Patent: Mar. 3, 1987

[54] SMALL STEPPING MOTOR DRIVEN WATCH

[75] Inventor: Paul Wuthrich, Watertown, Conn.

[73] Assignee: Timex Corporation, Waterbury, Conn.

[21] Appl. No.: 835,673

[22] Filed: Apr. 14, 1986

Related U.S. Application Data

[63] Continuation of Ser. No. 776,285, Sep. 16, 1985.

[51] Int. Cl.[4] ..... G04F 5/00

[52] U.S. Cl. ..... 368/157; 368/160

[58] Field of Search ..... 368/165, 156, 157, 76, 368/204, 322; 310/49 R, 40 MM

[56] References Cited

U.S. PATENT DOCUMENTS

| | | | |
|---|---|---|---|
| 4,084,403 | 4/1978 | Kitai et al. | 368/204 |
| 4,128,922 | 12/1978 | Egger et al. | 368/160 |
| 4,335,454 | 6/1982 | Yamada | 368/220 |
| 4,357,695 | 11/1982 | Bachmann | 368/322 |
| 4,443,112 | 4/1984 | Stotz et al. | 368/37 |
| 4,483,627 | 11/1984 | Muller et al. | 368/76 |

*Primary Examiner*—Bernard Roskoski

*Attorney, Agent, or Firm*—William C. Crutcher

[57] ABSTRACT

A movement for a two-hand quartz analog watch driven by a Lavet-type stepping motor has a minute hand on a shaft driven by a large center wheel overlapping the energy cell. The center wheel has 60 radial slots directly engaging and driven by the stepping motor rotor through a pair of diametrically opposed driving pins disposed in adjacent radial slots of the center wheel. The driving circuit steps the rotor 180 degrees once each minute. A reduction gear drives the hour hand mounted on a center pinion.

7 Claims, 3 Drawing Figures

SMALL STEPPING MOTOR DRIVEN WATCH

This application is a continuation of application Ser. No. 776,285, filed Sept. 16, 1985.

BACKGROUND OF THE INVENTION

This invention relates to an improved movement for a small two-hand quartz analog wristwatch, and more particularly relates to such a movement designed to be driven by a Lavet stepping motor with a low starting torque drive.

It is known that a quartz analog wristwatch movement can be designed to use only a minute hand and hour hand with the minute hand mounted on the same shaft as a center wheel and to index the center wheel once per minute with a quartz-controlled rocking motor. Such a construction is shown in U.S. Pat. No. 4,128,992—Egger, et al, issued Dec. 12, 1978. Inasmuch as the rocking motor required two shunt plates for the magnet and placed the gear reduction assembly between the center wheel and the dial, the watch movement tended to be rather thick.

An improved two-hand watch movement for a stepping motor providing a thinner watch construction placed the center wheel just below the dial and inverted the gear reduction assembly in such a manner that the minute hand is disposed on an inner sleeve and the hour hand is disposed on an outer sleeve, both journaled on a fixed center post. This arrangement was unconventional in locating the hour hand above the minute hand with respect to the dial of the watch and greatly reduced the watch thickness. Such a construction is shown in U.S. Pat. No. 4,443,112—Stotz, et al, issued Apr. 17, 1984. Due to the fact that this movement utilized a stepping motor which advanced the rotor only a fraction of a revolution each step, the center wheel required very small teeth and high starting torque at each step, hence, greater power consumption of the energy cell.

The power minimizing advantages of a Lavet motor, with a bi-polar rotor and a one-piece stator construction, wherein the rotor makes a 180 degree rotation each step is known in the prior art. Examples of such motors are shown in U.S. Pat. No. 4,398,107—Fukushima, issued Aug. 9, 1983; in U.S. Pat. No. 4,412,144—Denisov, issued Oct. 25, 1983; and in U.S. Pat. No. 4,335,454—Yamada, issued June 15, 1982.

One of the disadvantages of this type of stepping motor is its low starting torque. One way to overcome this problem is to prevent engagement of either of two pins driven by the rotor until the rotor has moved through a given angular interval, as shown in U.S. Pat. No. 4,084,402—Kitai et al., issued Apr. 18, 1978. Another type of drive for a bi-polar stepping motor using two pins to drive a toothed wheel where the rest position of the pins block the wheel during rest is shown in U.S. Pat. No. 4,357,695—Bachmann, issued Nov. 2, 1982 and in PCT Application, PCT/EP79/0025, filed 30 Mar. 1979 and published 15 Nov. 1979 as WO79/00930.

Lastly, U.S. Pat. No. 4,483,627—Muller, et. al., issued Nov. 20, 1984 discloses a bi-polar Lavet motor with a two-pin drive directly engaging the teeth of a seconds wheel driving a conventional gear train for a three-hand watch. Suggestions in the patent for producing a two-hand watch by altering the construction shown in the patent do not serve to reduce the thickness of the movement with the several layers of gearing shown.

Accordingly, one object of the present invention is to provide an improved thin, two-hand movement for a quartz analog wristwatch.

Another object of the invention is to provide an improved two-hand watch movement suitable for a Lavet bi-polar stepping motor.

Still another object of the invention is to provide an improved two-hand quartz analog stepping motor watch movement with a minimum number of components to reduce its cost.

DRAWINGS

The invention, both as to organization and method of practice, together with further objects and advantages thereof, will best be understood by reference to the following specification, taken in connection with the accompanying drawings, in which.

SUMMARY OF THE INVENTION

A timepiece movement has a plastic movement frame, a dial, an energy cell, a stepping motor with a stator and a rotor, and a driving circuit connected between the energy cell and stepping motor to periodically step the rotor. The movement frame includes first means rotatably mounted in the frame carrying an hour hand and an hour wheel thereon; second means rotatably mounted around the first means and carrying a minute hand, a center wheel overlapping the energy cell, and a center pinion thereon; and reduction gear and pinion rotatably mounted in the frame with the reduction gear engaging and driven by the center pinion and the reduction pinion engaging and driving the hour wheel, the aforesaid combination being shown in U.S. Pat. No. 4,443,112. The improvement herein comprises a center wheel having teeth with radial slots therebetween, the stepping motor rotor having a pair of driving pins disposed at rest position in adjacent center wheel radial slots, the driving circuit being arranged to step said rotor once per minute, whereby the minute hand is stepped once per minute by the Lavet stepping motor under conditions of low starting torque to minimize power consumption. End shake control members with small diameter pin journals reduce friction throughout the gear train.

DESCRIPTION OF THE PREFERRED EMBODIMENT

Figures 1, 1A:
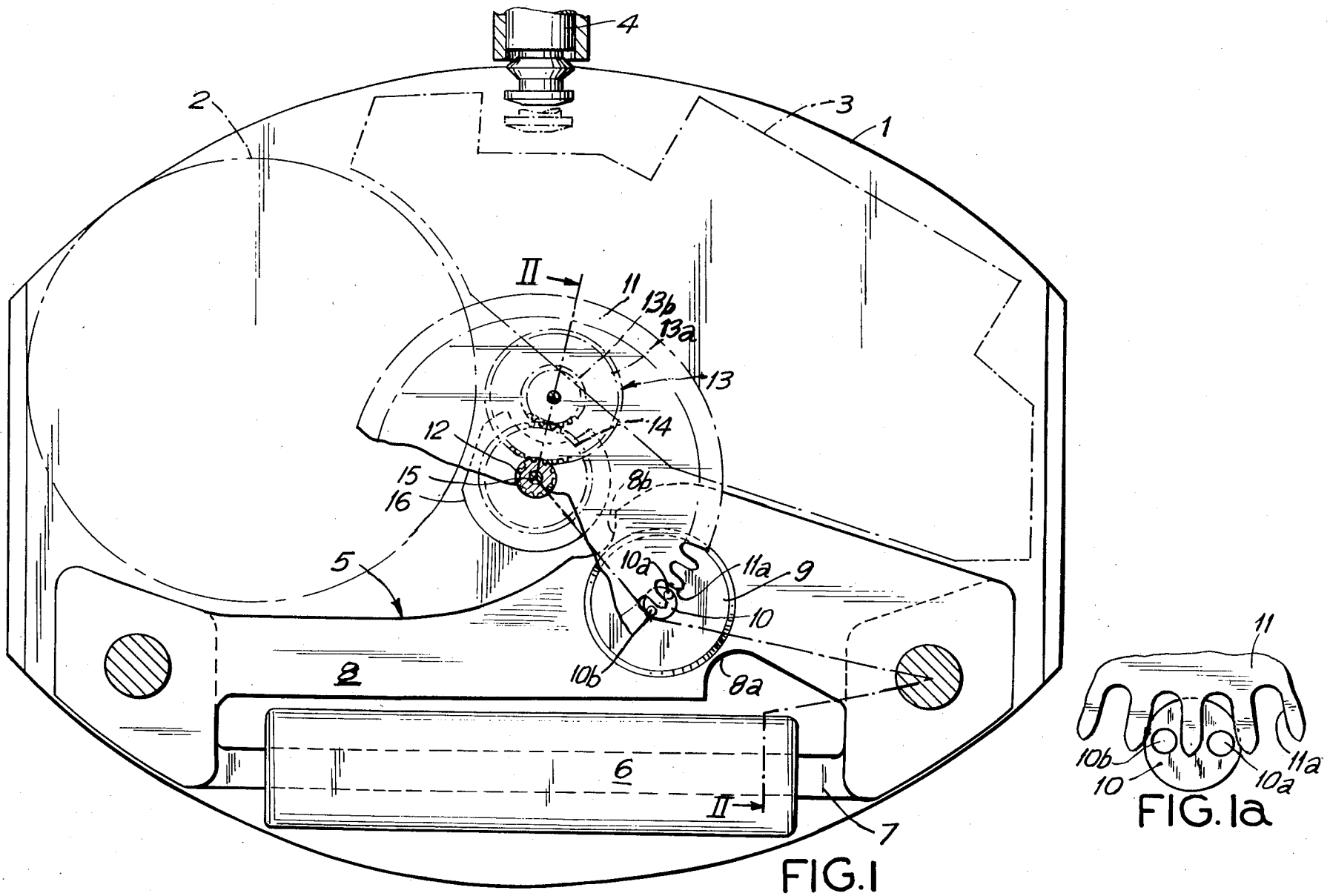
FIG. 1 is a plan view of the improved small stepping motor watch movement, omitting details of the electrical circuit for driving the stepping motor.
FIG. 1*a* is an enlarged plan view of the stepping motor at point of engagement with the center wheel teeth.

Referring now to FIG. 1 of the drawing, the movement is defined by the outlines of a plastic movement frame 1 defining recesses therein to house an energy cell 2 and a printed circuit board 3, both shown in phantom lines. The printed circuit board carries the conventional integrated circuit, discrete components such as the quartz crystal, and spring contacts for making contact with the energy cell and a watch stem pushbutton indicated by reference number 4.

A Lavet bi-polar stepping motor, shown generally at 5, comprises a coil 6 having its leads (not shown) connected to output terminals (not shown) on the printed circuit board 3. The integrated circuit is arranged to deliver driving pulses once per minute in a manner well known in the art. Passing through the center of coil 6 is a core 7, having its opposite ends overlapping and connected in magnetic circuit with a one-piece stator 8. Core 7 and stator 8 are stamped from magnetically permeable material. Stator 8 is of a type known in the prior art comprising a central opening into which is inserted a box assembly 9 of non-magnetic material housing a plastic rotor molded over a bi-polar permanent magnet (not shown). The stator is provided with diametrically opposed notches 8*a*, 8*b* providing narrow paths of high magnetic reluctance which become saturated during each driving pulse, causing the rotor to step 180 degrees and then stop to await the next pulse. The plastic end of the rotor, seen at 10, extends from the end of rotor box 9 and includes two parallel plastic pins 10*a*, 10*b* arranged to drive a center wheel 11 on the watch movement. Center wheel 11 preferably has 60 teeth defined between 60 radial slots 11*a*. As seen in the enlarged view of FIG. 1*a*, the rest position of the rotor 10 between steps is defined such that two pins 10*a*, 10*b* are disposed in two adjacent radial slots 11*a* between rotor steps, thereby blocking the center wheel against unwanted movement. The center wheel 11 is directly connected to a center pinion 12. Center pinion 12 drives a reduction gear and pinion assembly 13 rotatably supported in the frame, having a driven reduction gear 13*a* and a driving reduction pinion 13*b*, the latter meshing with an hour wheel 14. The gear ratios provide a 1:12 reduction between center wheel 11 and hour wheel 14. Hour wheel 14 is mounted on a central shaft 15 which is rotatably supported in the plastic frame and journaled in a special bridge bearing 16. The arrangement of the gearing members is best seen by reference to the developed cross section of FIG. 2.

Figure 2:
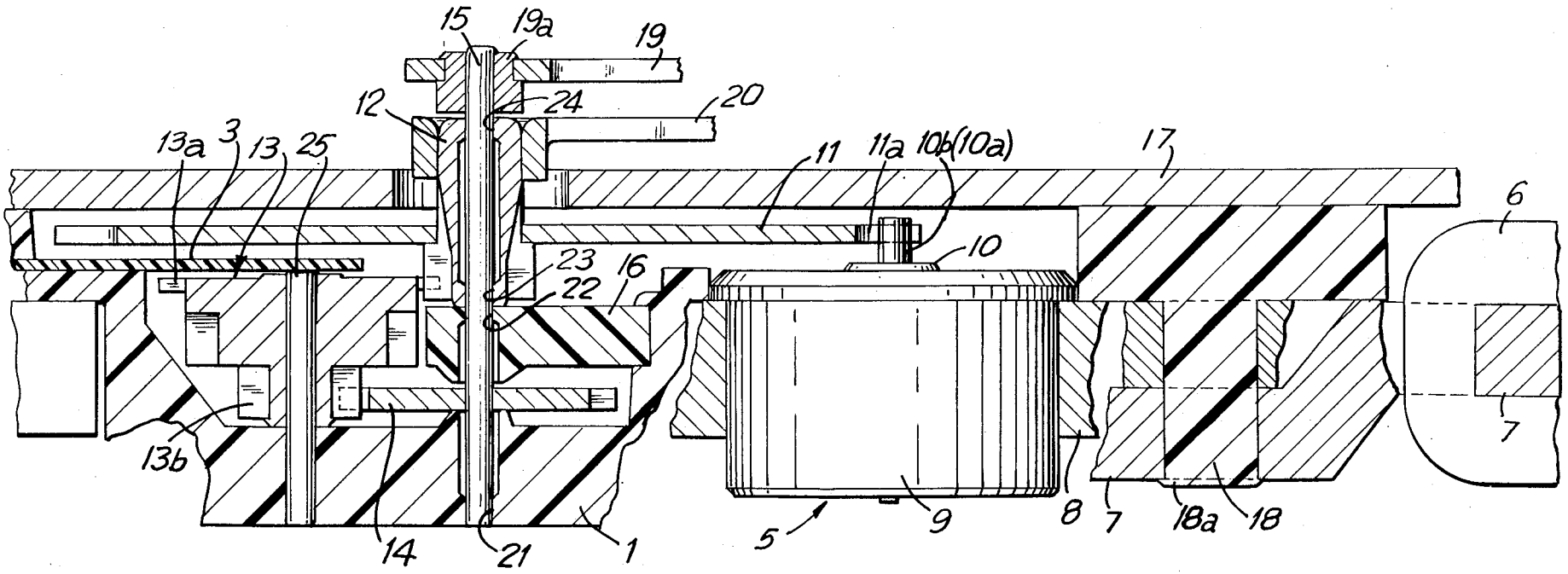
FIG. 2 is a developed, horizontal cross-sectional view taken along zig-zag lines II—II of FIG. 1.

Referring to FIG. 2, the plastic movement frame 1 supports a watch dial 17 and includes posts 18 which are used to secure the stator and core piece of the stepping motor to the frame. This is done by upsetting the post end at 18*a* by heat forming.

An hour hand 19 is carried on a bushing 19*a* fixed on the center shaft 15, and a minute hand 20 is carried on the center pinion 12. In this arrangement, the hour hand is above the minute hand with respect to dial 17.

The hour wheel 14, center shaft 15 and hour hand 19 comprise first means rotatably mounted in the frame. Shaft 15 is journaled at two spaced locations 21, 22 of very small diameter, and hence comprise low friction mountings. For example, the diameter of shaft 15 is only on the order of 0.2 mm. Center wheel 11, center pinion 12 and minute hand 20 comprise second means rotatably mounted around the first means. The center pinion is journaled at small diameter, spaced bores 23, 24 in the center pinion, therefore comprising low friction journals for the center wheel 11. Axial (end shake) movement for the first rotatably mounted means is controlled by the hour wheel 14 clearance between end shake control members comprising the frame 1 and bridge bearing 16. Axial (end shake) movement for the second rotatably mounted means is controlled by the center pinion 12 clearance between end shake control members comprising the bridge bearing 16 and hour hand pushing 19*a*.

The 1:12 reduction gear assembly 13 is mounted on a fixed small diameter pin 25 carried in the plastic frame. End shake movement of the assembly 13 is controlled between end shake control members comprising the frame 1 and a portion of the PCB 3. The bridge bearing 16 is axially located on shaft 15 between the point where the gear teeth of pinion 13*b* mesh with the teeth of hour wheel 14 and the point where the teeth of gear 13*a* mesh with teeth of center pinion 12. The foregoing provides a very compact low friction arrangement for the gear reduction between the first and second rotating assemblies.

OPERATION

In operation, the stepping motor rotor is stepped 180 degrees once each minute to advance the center wheel by 1/60th of a revolution, thereby moving the minute hand 20 by one minute at each step. With the two-pin rotor drive, the stepping motor commences each step with a low starting torque, because at the commencement of the step, there is no initial resistance by the teeth of the center wheel. The center pinion 12 drives the hour wheel 14 through a 1:12 gear reduction. Since the journals for the reduction gear assembly, center wheel pinion and the central shaft 15 are all small diameter, having end shake control members there is a minimal bearing friction when the rotor commences its step, and hence low overall power consumption by the movement.

While there has been described what is considered to be the preferred embodiment of the invention, other modifications will occur to those skilled in the art, and it is desired to secure in the appended claims, all such modifications as fall within the true spirit and scope of the invention.

I claim:

1. In a timepiece having a movement frame, a dial, an energy cell, a stepping motor with a stator and a rotor, a driving circuit mounted on a circuit board and electrically connected to the stepping motor and adapted to periodically step the rotor, first means rotatably mounted on said movement frame carrying an hour hand bushing and an hour wheel thereon, second means rotatably mounted around said first means and carrying a minute hand, a center wheel and a center pinion thereon, and reduction means rotatably mounted on the frame, said reduction means having a reduction gear engaging and driven by said center pinion and a reduction pinion engaging and driving said hour wheel, the improvement comprising:

said center wheel being disposed immediately below said dial and overlapping the energy cell and having 60 teeth defining radial slots therebetween, said stepping motor rotor having a pair of driving pins disposed to successively engage a pair of adjacent radial slots, said driving circuit being adapted to step said rotor 180 degrees once each minute, said hour hand being advanced when said second means acts through said reduction means to cause said first means to rotate within said second means, whereby the minute hand and hour hand are advanced once per minute by the stepping motor.

2. The improvement according to claim 1, including a plurality of end shake control members, arranged and disposed such that axial movements of the first means, second means and reduction means are limited to axial movement between said end shake control members.

3. The improvement according to claim 2, further including a bridge bearing fixed above said frame, and wherein said hour wheel is disposed between, and is permitted limited axial movement between, the bridge bearing and the frame, said first means comprising a center shaft journaled in said frame and in said bridge bearing, said frame and bridge bearing serving as said end shake control members for the first means.

4. The improvement according to claim 2, further including a bridge bearing fixed in said frame and wherein said center pinion is disposed between, and is permitted limited axial movement between, said bridge bearing and said hour hand bushing, said bridge bearing and said hour hand bushing serving as said end shake control members for the second means.

5. The improvement according to claim 2, further including a pin member fixed in said frame, said reduction means being rotatably mounted on said pin member, said circuit board having a portion extending over said pin member, said frame and said portion of said circuit board serving as said end shake control members for said reduction means.

6. The improvement according to claim 1, wherein said center wheel, center pinion, hour wheel and reduction means are all located between said dial and said movement frame.

7. The improvement according to claim 1, wherein said driving pins of said stepping motor rotor are disposed on the end of said rotor toward said dial.

* * * * *